US005738123A

United States Patent [19]

Szekely

[11] Patent Number: 5,738,123

[45] Date of Patent: Apr. 14, 1998

[54] SAMPLER APPLICATOR

[75] Inventor: Alex Szekely, Manalapan, N.J.

[73] Assignee: The Plastek Group, Erie, Pa.

[21] Appl. No.: 660,143

[22] Filed: Jun. 7, 1996

[51] Int. Cl.[6] ..... A45D 40/24

[52] U.S. Cl. ..... 132/318; 132/320; 401/98

[58] Field of Search ..... 132/317, 318, 132/319, 320; 401/88, 98; 220/212, 213, 258; 206/606, 623

[56] References Cited

U.S. PATENT DOCUMENTS

| | | | |
|---|---|---|---|
| 4,235,557 | 11/1980 | Hayes | 401/98 |
| 4,552,161 | 11/1985 | Hill et al. | 132/318 |
| 4,700,448 | 10/1987 | Parker | 401/98 |
| 4,728,210 | 3/1988 | Barish et al. | 401/98 |
| 4,890,944 | 1/1990 | Cousins et al. | 401/98 |
| 5,167,462 | 12/1992 | Lucas | 401/98 |
| 5,326,185 | 7/1994 | Dornbusch et al. | 401/88 |
| 5,547,302 | 8/1996 | Dornbusch et al. | 401/172 |

*Primary Examiner*—Gene Mancene
*Assistant Examiner*—Pedro Philogene
*Attorney, Agent, or Firm*—Bachman & Lapointe, P.C.

[57] ABSTRACT

A method and apparatus for devising an applicator including a method of securing a settable material in the applicator operable to apply cosmetic materials to an external surface.

8 Claims, 2 Drawing Sheets

SAMPLER APPLICATOR

BACKGROUND OF THE INVENTION

The present invention relates to applicators containing material to be applied to surfaces as well as a method of combining the applicator and the material including the combination of the applicator and the material, per se.

SUMMARY OF THE INVENTION

For example, the present invention deals with materials that are introduced into the applicator in a pourable condition at temperatures ranging from 167° to 185° F. Thereafter the applicator containing the material is cooled at temperatures ranging from 50° to 65° F. whereupon the material is molded, sets to a solid condition and is keyed to the applicator ready for use.

While the present invention is not so limited a typical settable product can be classified as a cosmetic including deodorants, antiperspirants and the like.

Upon introduction in pourable condition the settable material normally has a viscosity ranging from 160 to 200 centipoises.

One aspect of the invention involves a method of loading, molding and keying the material to the applicator.

Another aspect of the invention is directed to the combination of the applicator and the settable material as a useful product.

One object of the invention is to provide a prospective purchaser, user or manufacturer with a means for testing the efficacy or suitability of a particular material for its desired use.

That is, the applicator is useful for a limited number of applications sufficient to make a decision regarding the utility and other required attributes of a product or material proposed for mass commercialization.

A further object of the invention is the provision of a novel method of loading, molding and anchoring settable material to the applicator.

A typical applicator according to the invention may comprise a barrel means having opposed removable closures with a grid means fixed within the barrel which when submerged in the settable material provides an anchor or means for securing the material in solid form to the barrel.

One removable closure serves as a mold to shape the material in the set condition to a desired configuration.

Other features and advantages of the present invention will become apparent from an examination of the succeeding specification when read in conjunction with the appended drawings, in which;

DESCRIPTION OF THE PREFERRED EMBODIMENT

Figure 1:
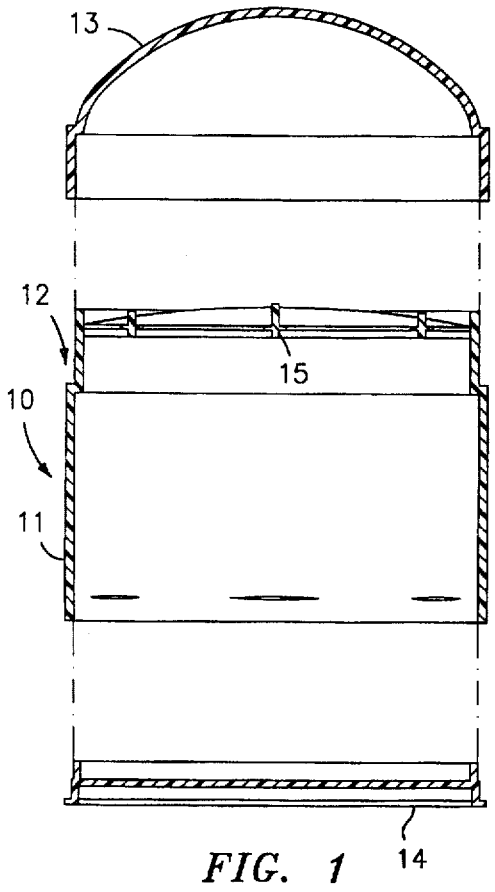
FIG. 1 is an exploded elevation, in section, showing the barrel, closure means and grid means.

The present invention has general applicability to settable compounds but is used most advantageously with materials that have cosmetic properties.

Referring to FIGS. 1 through 5 the reference numeral 10 denotes a hollow plastic barrel having a side wall 11, stepped in at 12 to receive a mating domed removable closure 13. The opposite end of the barrel receives a removable closure 14. A grid means 15 is shown fixed to sidewall 11 in the interior of the barrel.

Figure 2:
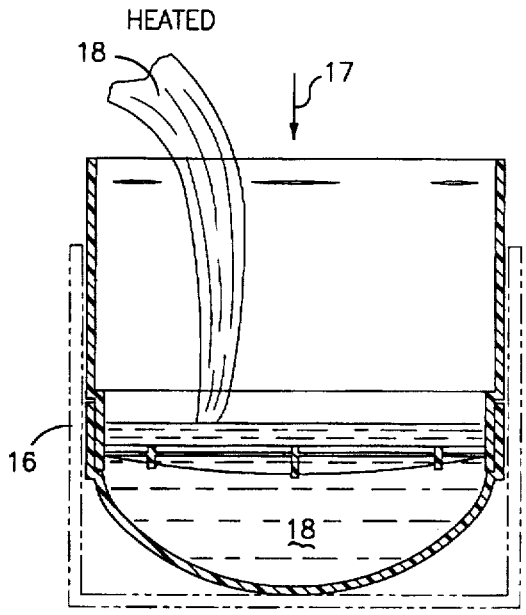
FIG. 2 is similar to FIG. 1 showing the barrel inverted, positioned in a fixture, containing pourable material in which the grid is submerged.

FIG. 2 shows the barrel 10 supported in a fixture or jig 16 with closure 13 in the closed position and the closure 14 removed.

As indicated by the arrow 17 settable material 18, heated to the appropriate temperature for pouring, is shown filling the domed closure 13 and a portion of the barrel sufficient to submerge the grid 15.

Figure 3:
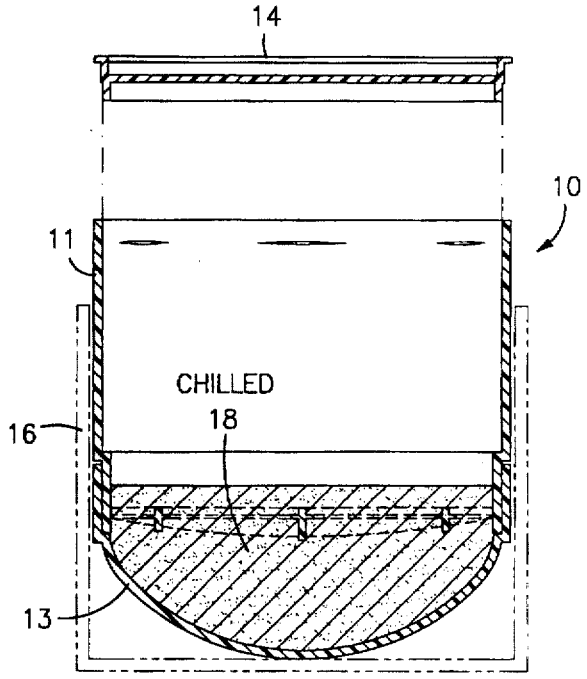
FIG. 3 is similar to FIG. 2 showing the material in set condition.
Figure 5:
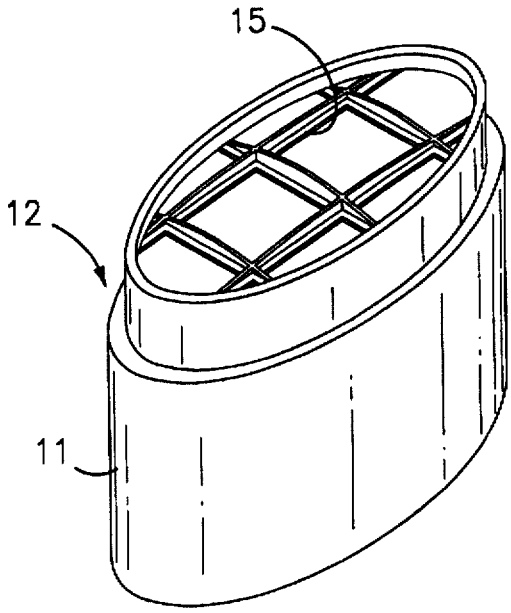
FIG. 5 is a perspective view of a portion of the barrel showing the configuration and disposition of the grid within the barrel prior to loading the barrel with settable material.

FIG. 3 shows the material 18 set to a solid condition locked to the grid 15 and with the closure 14 poised for engaging the barrel.

Figure 4:
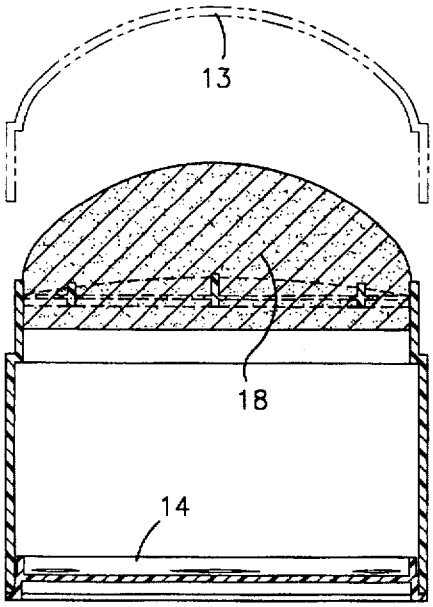
FIG. 4 shows the combined barrel and solid material in operable position with one closure means removed after having served as a mold.

FIG. 4 shows the total unit i.e. barrel 10 and solid material 18, in upright position ready for operation.

The domed closure 13 is shown removed exposing the solid material 18 ready for use. For example, if the material 18 is an antiperspirant one has merely to grasp the barrel and wipe the exposed perspirant upon the surface or skin area to be treated.

After use the dome closure 13 is replaced to protect the remaining material.

As stated earlier since the purpose of the unit is to provide an operable and convenient means to test the efficacy of a given sample of a solid material there are a limited number of wiping strokes available before the dome shape of the material 18 is eroded to the level of the grid. Note too that the grid serves to anchor the solid material to the barrel.

The method practiced to create that combination of elements shown in FIG. 4 comprise the steps of heating a desired settable material to a temperature ranging from 167° to 185° F. to render the material pourable as shown in FIG. 2. Sufficient material is introduced to cover the grid. Thereafter the material is chilled to a temperature ranging from 50° to 65° F. to render the material solid. During the chilling step the closure 13 acts to mold the solid material to the configuration of the closure. The domed configuration is merely representative of a typical shape; obviously a wide variety of shapes may be devised without departing from the spirit and scope of the invention.

Furthermore while the exemplary embodiment of the invention deals with cosmetics it is entirely possible that the present invention may be utilized to sample and test a wide variety of settable materials.

What is claimed is:

1. An applicator, comprising:

a barrel having a first open end and a second open end;

a grid fixed within said barrel;

a mass of molded material extending from said first open end and extending into said barrel beyond said grid toward said second open end whereby said mass of molded material engages said grid;

a first cap releasably enclosing said first open end; and a second cap enclosing said second open end.

2. The applicator of claim 1 wherein the first cap is formed with a predetermined shape thereby providing a mold for said molded material.

3. The applicator of claim 2 wherein the mold is dome-shaped.

4. The applicator of claim 1 wherein the molded material is a cosmetic.

5. An applicator according to claim 1 wherein said grid is vertically and rotationally fixed relative to said barrel.

6. An applicator according to claim 1, wherein said grid is an integrally formed portion of said barrel.

7. An applicator according to claim 1, wherein said mass of molded material is molded to an interior surface of said first cap.

8. An applicator according to claim 1, wherein said grid is fixed within said barrel substantially coplanar with said first open end.

* * * * *